US005660232A

United States Patent [19]

Reinhardt

[11] Patent Number: 5,660,232

[45] Date of Patent: Aug. 26, 1997

[54] LINER VALVE WITH EXTERNALLY MOUNTED PERFORATION CHARGES

[75] Inventor: Paul Andrew Reinhardt, Houston, Tex.

[73] Assignee: Baker Hughes Incorporated, Houston, Tex.

[21] Appl. No.: 335,636

[22] Filed: Nov. 8, 1994

[51] Int. Cl.[6] ..... E21B 43/116; E21B 34/06

[52] U.S. Cl. ..... 166/297; 166/55.1; 166/242.1; 166/317; 166/369

[58] Field of Search ..... 166/297, 55.1, 166/317, 242.1, 369

[56] References Cited

U.S. PATENT DOCUMENTS

| | | |
|---|---|---|
| 2,707,997 | 5/1955 | Zandmer et al. . |
| 2,708,000 | 5/1955 | Zandmer . |
| 2,775,304 | 12/1956 | Zandmer . |
| 2,855,049 | 10/1958 | Zandmer . |
| 3,057,405 | 10/1962 | Mallinger . |
| 3,120,268 | 2/1964 | Caldwell . |
| 3,245,472 | 4/1966 | Zandmer . |
| 3,326,291 | 6/1967 | Zandmer . |
| 3,347,317 | 10/1967 | Zandmer . |
| 3,382,926 | 5/1968 | Zandmer . |
| 3,390,724 | 7/1968 | Caldwell . |
| 3,395,758 | 8/1968 | Kelly et al. . |
| 3,434,537 | 3/1969 | Zandmer . |
| 3,924,677 | 12/1975 | Prenner et al. . |
| 4,285,398 | 8/1981 | Zandmer . |
| 4,880,059 | 11/1989 | Brandell et al. . |
| 4,991,654 | 2/1991 | Brandell et al. . |

OTHER PUBLICATIONS

A. Damgaard, et al., A Unique Method for Perforating, Fracturing and Completing Horizontal Wells, *Society of Petroleum Engineers,* SPE No. 19282, 1989.

*Primary Examiner*—Hoang C. Dang
*Attorney, Agent, or Firm*—Rosenblatt & Redano P.C.

[57] ABSTRACT

The apparatus and method of the present invention involve a casing or liner component that has a sliding sleeve operable therein. A plurality of ports are plugged off externally to the liner. A series of perforating charges are aligned adjacent the plugs extending from the ports which they plug. The charges may be set off hydraulically with the valve within the liner in the open or closed position, depending on the configuration. The perforating charges may be oriented differently with respect to each other to increase the zone of perforation of the formation. The plugs and charges can be distributed in such a manner as to obtain significant coverage of perforations for the zone in question.

19 Claims, 9 Drawing Sheets

LINER VALVE WITH EXTERNALLY MOUNTED PERFORATION CHARGES

FIELD OF THE INVENTION

The field of this invention relates to casings or liners, particularly those with built-in valve members and featuring perforating charges externally mounted thereto.

BACKGROUND OF THE INVENTION

In the past, a wellbore has been drilled and cased to a certain depth. Thereafter, liners are installed and the assembly is cemented. Thereafter, perforating guns are lowered from the surface to perforate at the desired intervals. Each time the perforating gun is shot, it must be retrieved to the surface, reloaded, and lowered again to the desired depth for additional perforation. Multiple trips in and out of the wellbore with the perforating gun cause delays which translate into operating costs for the well owner. Additionally, handling of perforating guns at the surface has its inherent hazards. To answer these needs, the apparatus and method of the present invention have been developed. It features a liner which includes a sliding sleeve. A plurality of ports can be covered or uncovered by the sliding sleeve. The shaped charges are mounted externally to the liner and the entire assembly is lowered into the wellbore to the desired depth. Multiple sections can be used so that the perforation occurs at the desired depth or depths. Once the entire assembly is installed, the charges are set off from the surface at the desired depths. A packer may then be set and a production string installed for production from the formation. Alternatively, a packer can be run and the well completed before setting of the charges.

SUMMARY OF THE INVENTION

The apparatus and method of the present invention involve a casing or liner component that has a sliding sleeve operable therein. A plurality of ports are plugged off externally to the liner. A series of perforating charges are aligned adjacent the plugs extending from the ports which they plug. The charges may be set off hydraulically with the valve within the liner in the open or closed position, depending on the configuration. The perforating charges may be oriented differently with respect to each other to increase the zone of perforation of the formation. The plugs and charges can be distributed in such a manner as to obtain significant coverage of perforations for the zone in question.

DETAILED DESCRIPTION OF THE PREFERRED EMBODIMENT

Figure 1A:
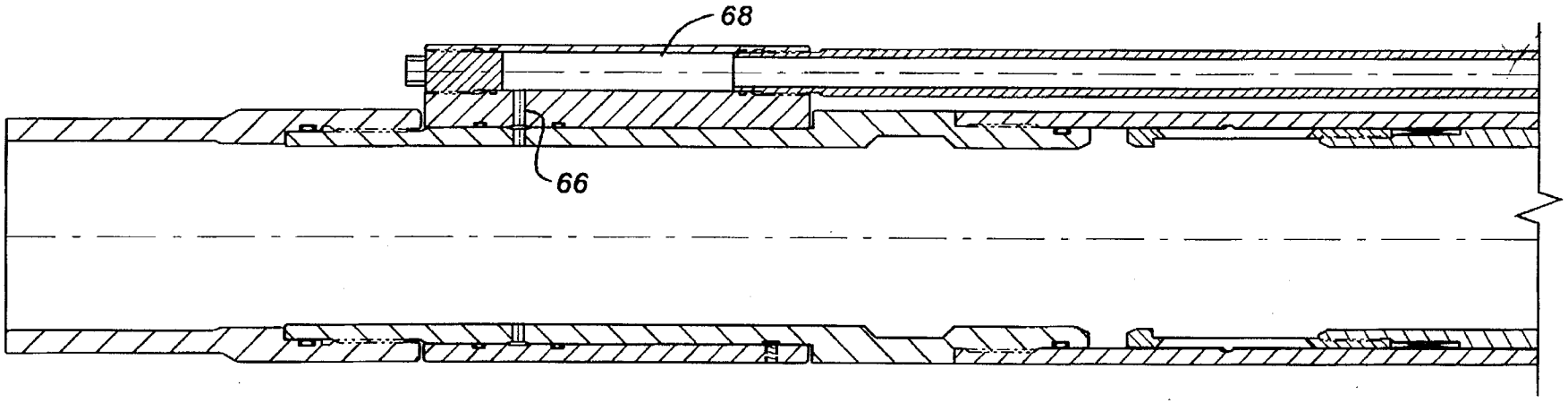
FIGS. 1A–1C are a sectional elevational view of a preferred embodiment of the apparatus and method.
Figure 2A:
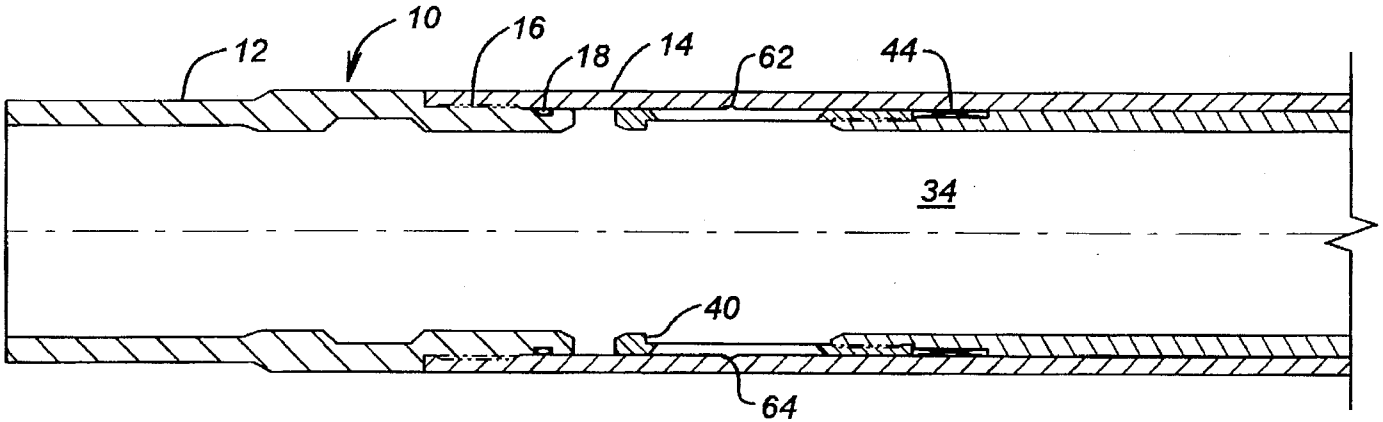
FIGS. 2A–2C are an alternative embodiment of the apparatus and method illustrated in FIGS. 1A–1C.
Figure 1B:
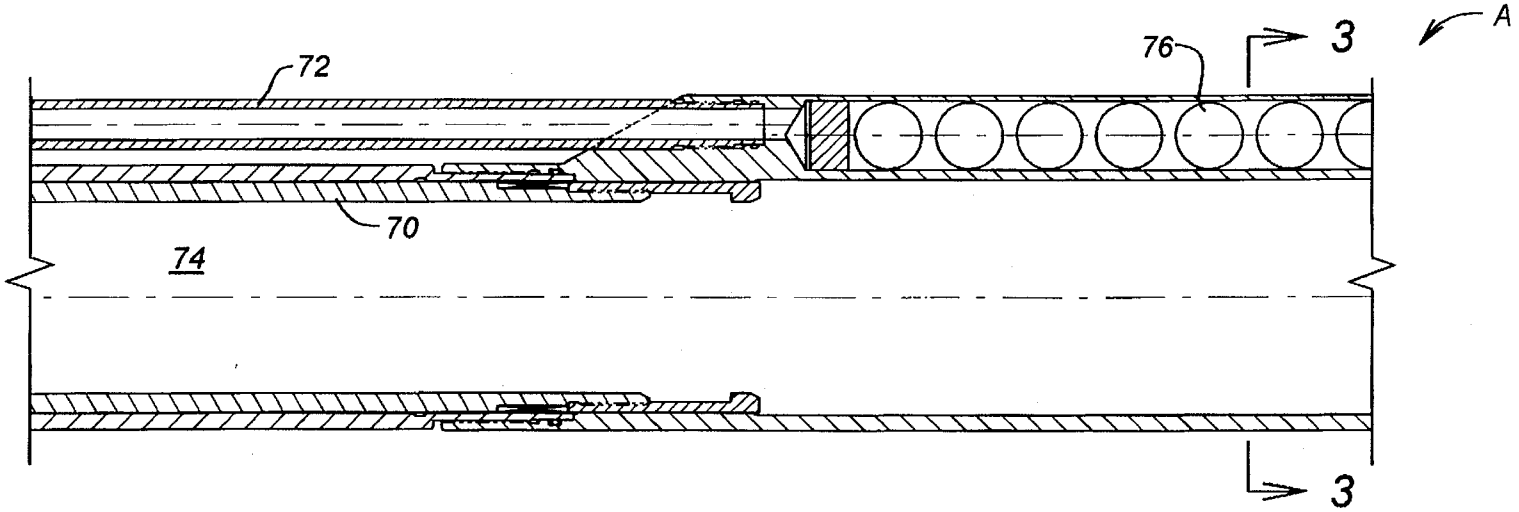
Figure 2B:
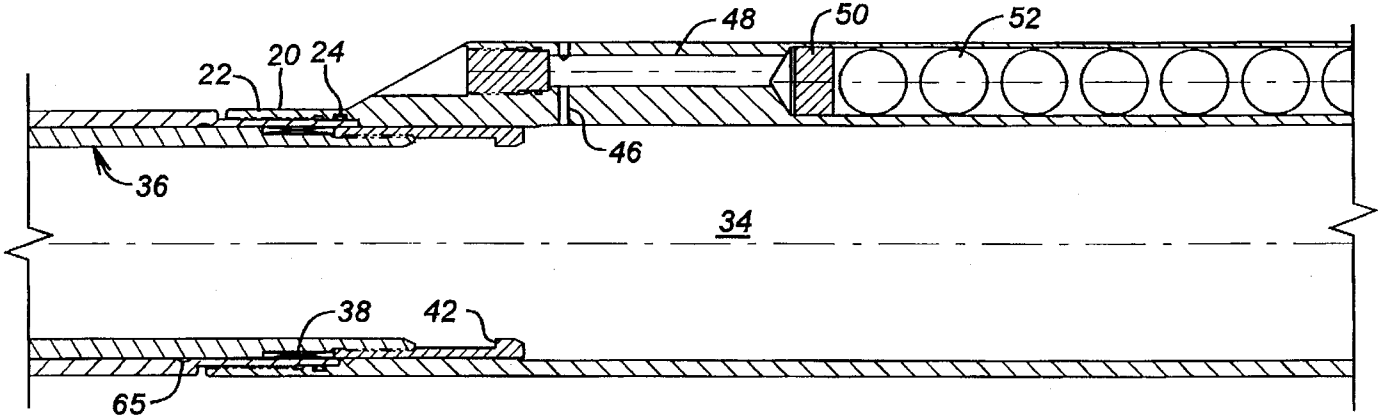
Figure 1C:
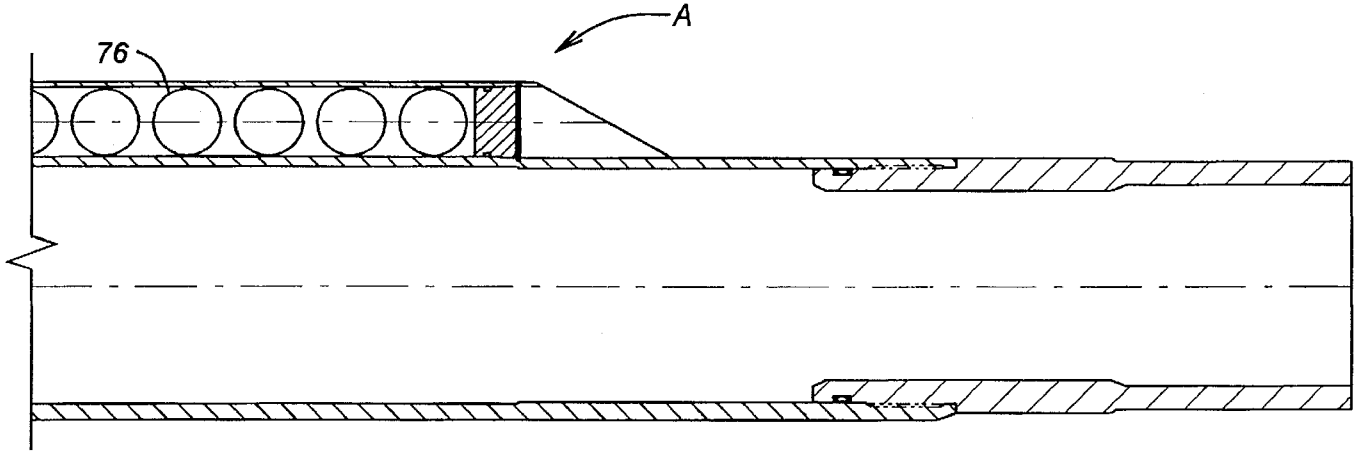
Figure 2C:
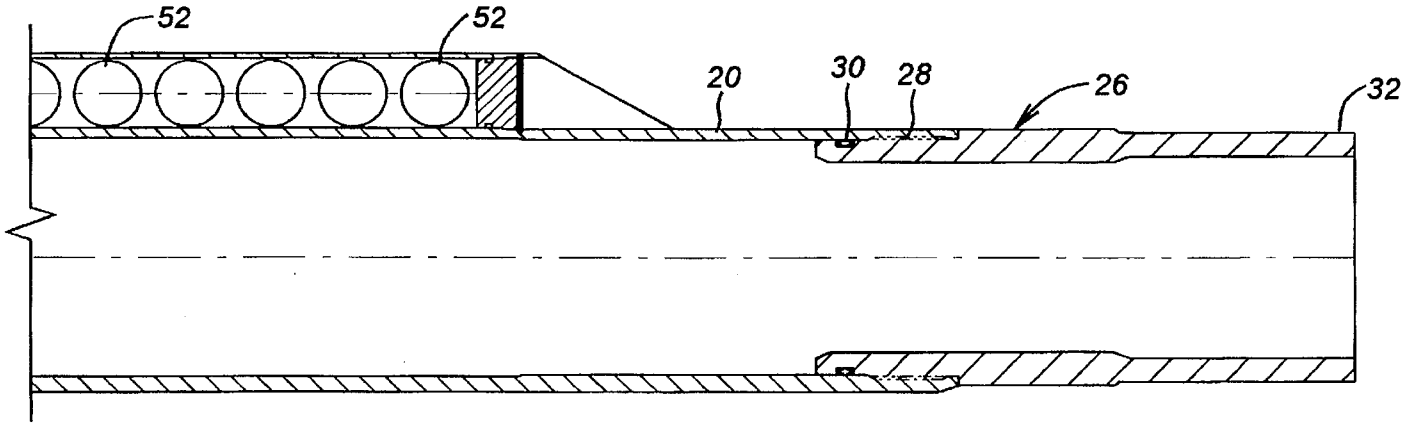

The apparatus A of the present invention can be understood by a review of FIGS. 1A–1C, 2A–2C, and 3. Referring now to FIGS. 2A–2C, the apparatus A has an upper section 10 which can be threaded per the requirements of the end user. The connection thread is placed in area 12 of upper segment 10. Upper segment 10 is connected to body 14 at thread 16. The threaded connection 16 is sealed off by seal 18. Body section 14 is connected to body section 20 at thread 22. Threaded connection 22 is sealed by seal 24. At the lower end of body section 20, as seen in FIG. 2C, a lower section 26 is connected by thread 28, which is in turn sealingly secured by seal 30. Any thread or end connection as required can be placed in area 32 of lower section 26. Accordingly, a plurality of assemblies as illustrated in FIGS. 2A–2C may be connected to each other and oriented in an offset manner with respect to the longitudinal axis that would extend through such a stack.

Figure 3:
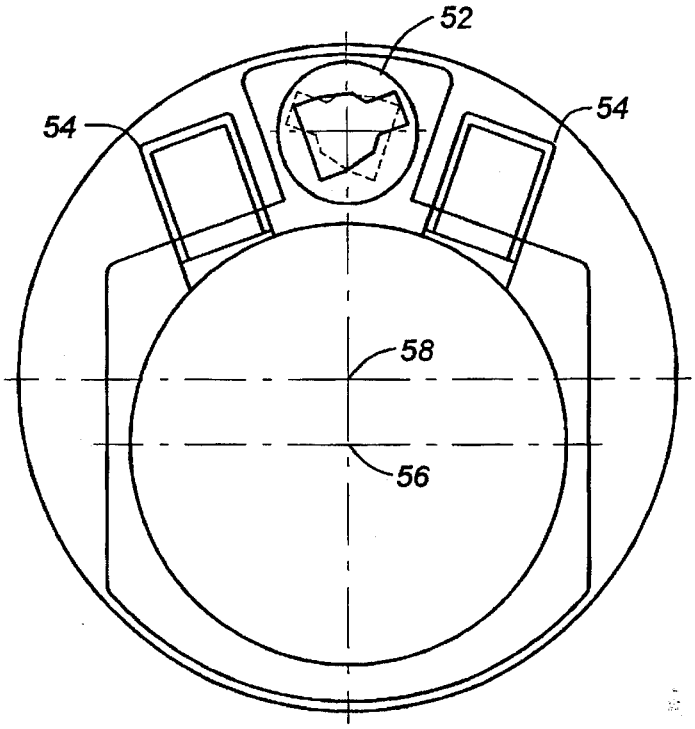
FIG. 3 is a sectional view taken along lines 3—3 of FIG. 1B.

Referring now to FIGS. 2B–2C and 3, it can be seen that the body sections 10, 14, 20, and 26 have a bore 34 therethrough. A sliding sleeve 36 is shown in the open position in FIGS. 2A–2B. Sliding sleeve 36 is sealed against bore 34 by seal 38 (see FIG. 2B). Sleeve 36 can be manipulated between its open and closed positions by a shifting tool of the type known to those skilled in the art. Such a shifting tool would engage shoulders 40 or 42 for movement, respectively, toward the open and closed positions. At its upper end, sleeve 36 is sealed off against bore 34 by seal 44.

A lateral pressure port 46 extends from bore 34 into firing head 48. Firing head 48 is in communication with booster 50, which in turn is in communication with the shaped perforating charges 52.

Figure 6:
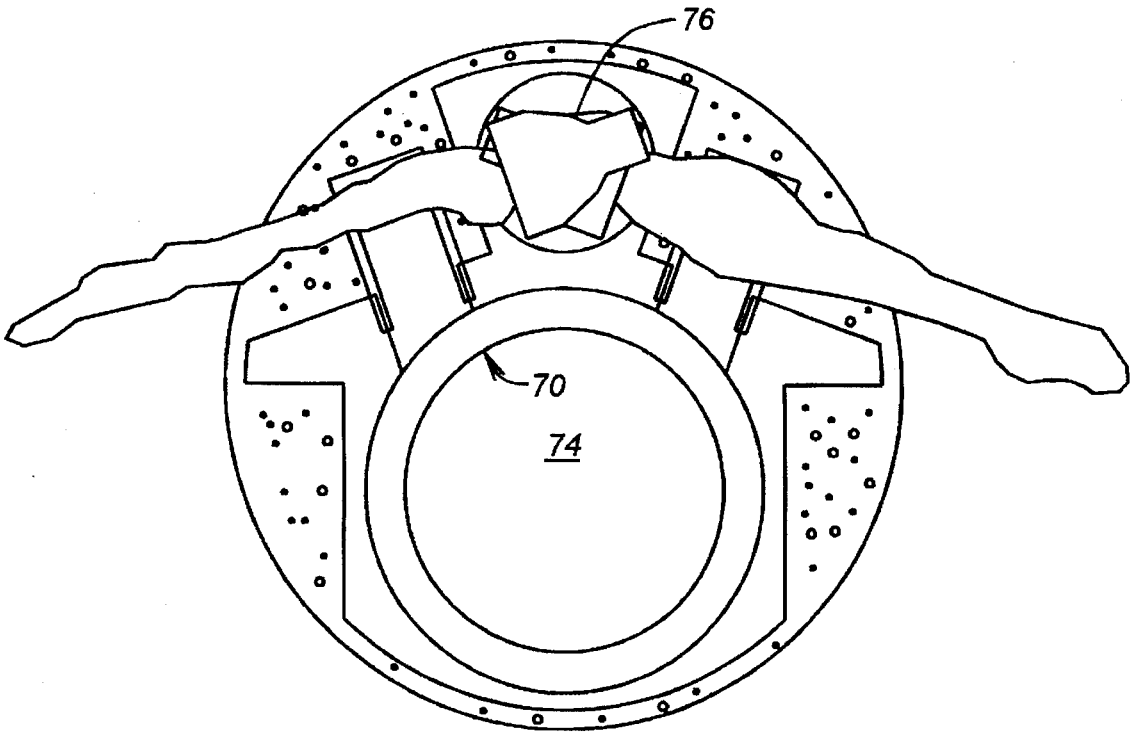
FIG. 6 is the view of FIG. 5 during the perforating operation.

Referring now to FIG. 3, it can be seen that the shaped perforating charges 52 are preferably in a vertical stack but can be oriented offset with respect to each other in a phasing range that extends approximately 180°–220°. Two different orientations with respect to the vertical longitudinal axis are illustrated in FIG. 3, one in solid lines and one in dashed lines. Despite the different orientations shown in FIG. 3 and within the range of approximately 180°–220°, each of the shaped charges 52 is still oriented in such a way that upon actuation of the explosive charge 52, a portion of a plug 54 will be blown away, thus opening up a passage to bore 34, as schematically illustrated in FIG. 6.

Looking at FIG. 3, it can be seen that the centerline 56 of bore 34 is offset from the wellbore centerline 58 in the preferred embodiment. This offsetting allows for the external placement of the perforation charges 52, as well as the disposing of the plugs 54 on alternate sides of the stacked array of charges 52. It is also within the scope of the invention to modify the size of plugs 54 as well as charges 52 while making the centerline 56 of bore 34 concentric with the centerline of the wellbore 58 so that plugs 54 and charges 52 can be placed on the exterior of body sections 14 and 20 in such a way that they are oriented as a group to cover 360° around the wellbore for perforation in all directions. As can be seen in comparing FIGS. 4 and 5, the offset nature of the preferred embodiment allows cement 60 to flow around and past plugs 54 and shaped charges 52.

Figure 7:
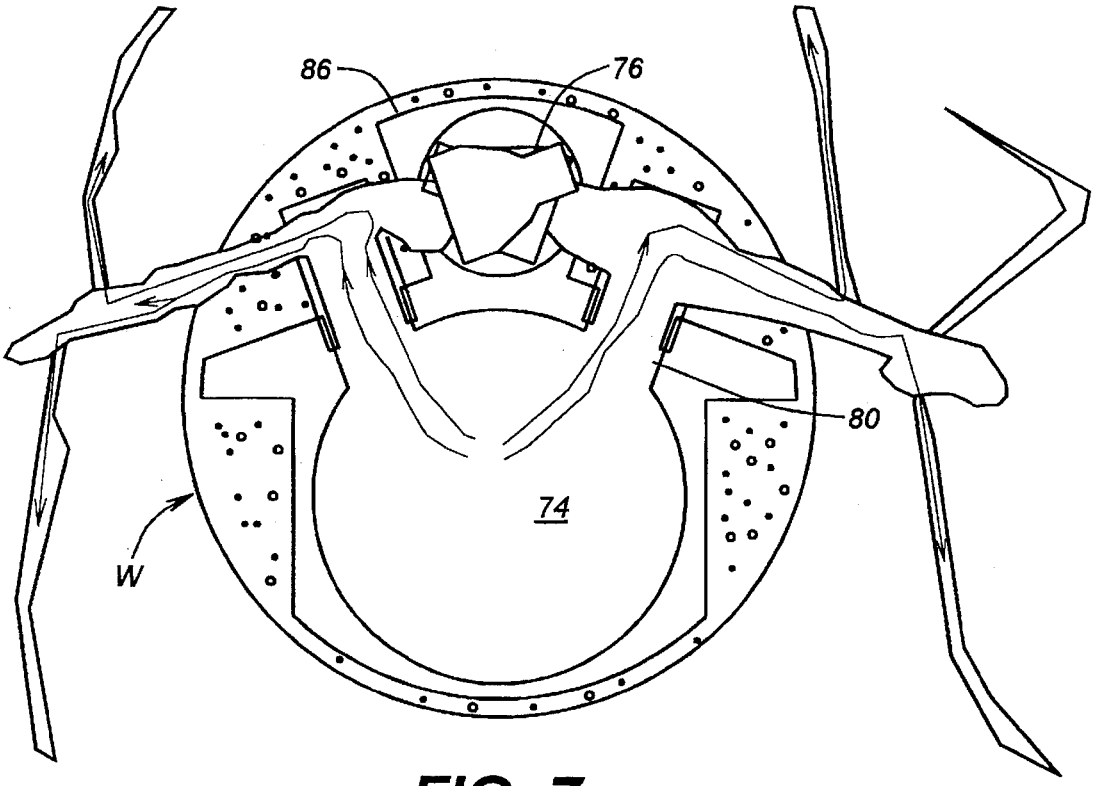
FIG. 7 is the view of FIG. 6 during the fracturing operation.

It should be noted that in the embodiment shown in FIGS. 2A–2C, port 46 is only exposed to pressures applied in bore 34 when sleeve 36 is in the open position, as illustrated in FIGS. 2A–2C. In FIGS. 2A–2C, the sleeve 36 when pulled to its open position latches due to the engagement of tang 62 and detent 64. In the closed position, detent 64 latches to tang 65 (FIG. 2B). When placed in this position, pressure applied in bore 34 is communicated through port 46 to set off the firing head and booster 48 and 50, which ultimately results in setting off all the charges 52. Ultimately, as shown in FIGS. 6 and 7, the setting off of the charges 52 results in shearing off of the plugs 54 and opening up a plurality of flow passages from the perforated formation into bore 34. The advantage of the design as illustrated in FIG. 2 is that the shaped charges 52 can be placed at different depths within the wellbore. By covering up various respective ports 46, only the shaped charges at the desired depths can be set off by applying pressure in bore 34. This system of allowing a stacking of liners, such as shown in FIGS. 2A–2C, gives the operator an advantage in that each time the shaped charges 52 are to be set off, another trip into the wellbore with a perforating gun is avoided. Instead, the shifting tool is merely repositioned at a different depth to open yet another sleeve 36 to expose a different set of perforating charges 52 at a slightly different or a much greater depth than the original charges 52 which had previously been set off. Therefore, depending on the needs of a particular well application, the apparatus A can be stacked with perforating charges closer or more remotely mounted from each other for subsequent use in perforating the formation.

As can be seen, the embodiment in FIGS. 1A–1C is slightly different than that shown in FIGS. 2A–2C. Here, in FIGS. 1A–1C, a port 66 is always exposed to a firing head 68. This is true regardless of the position of the sliding sleeve 70, which is shown in FIGS. 1A–1C in the open position. FIGS. 1A–1C also illustrate the use of a time delay 72. If there is a stack of similar installations in a wellbore, each may have a different time delay. While pressurization in the bore 74 of the apparatus A shown FIG. 1 will necessarily set off all the firing heads, the staggered time delays for each element of a stack of charges can be set for a different time, which will then communicate to the operating personnel at the surface that all of the charges at different depths in the stack have actually gone off downhole. This is true because each time one group of charges goes off, there is an indication at the surface through the reaction to the explosion that it has, in fact, taken place. Depending on the depth, this is experienced in a pressure surge or other audible means at the surface. Again, the layout of the charges 76 in FIGS. 1A–1C is similar to that shown in FIGS. 2A–2C. The alternative layout of the charges to cover a greater range than 180°–220°, with the embodiments shown in FIGS. 1 and 2, is also possible with both versions, with minor modifications as previously described.

Figure 4:
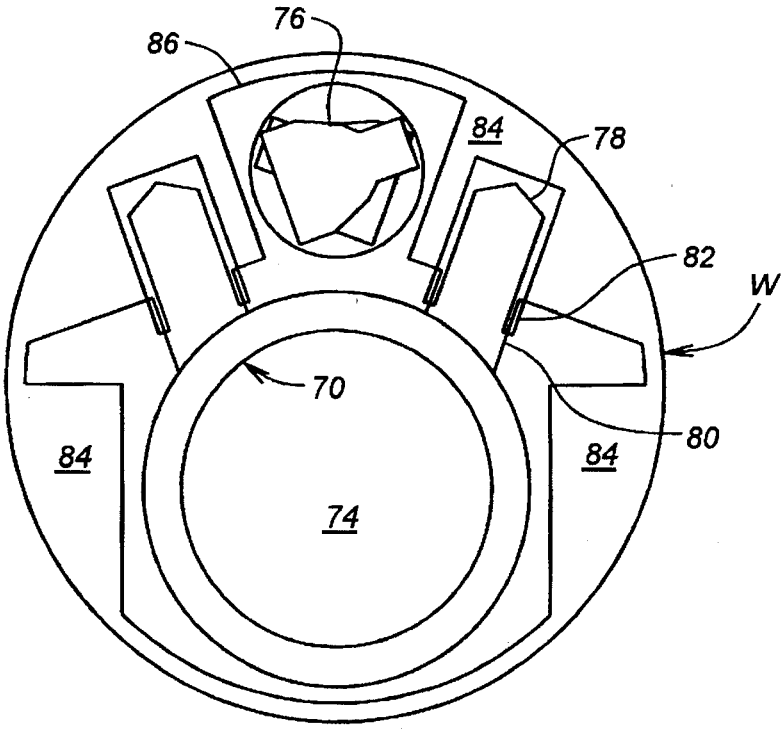
FIG. 4 is a schematic representation of a section through the apparatus shown in FIGS. 1A–1C in the run-in position.

The offset nature of bores 34 or 74 is best illustrated by a review of FIG. 4. FIG. 4 is similar to the view of a section 3—3 taken through FIG. 1B. Here, as seen in section 3—3 of FIG. 1, bore 74 is offset from the centerline of the wellbore W.

Figure 5:
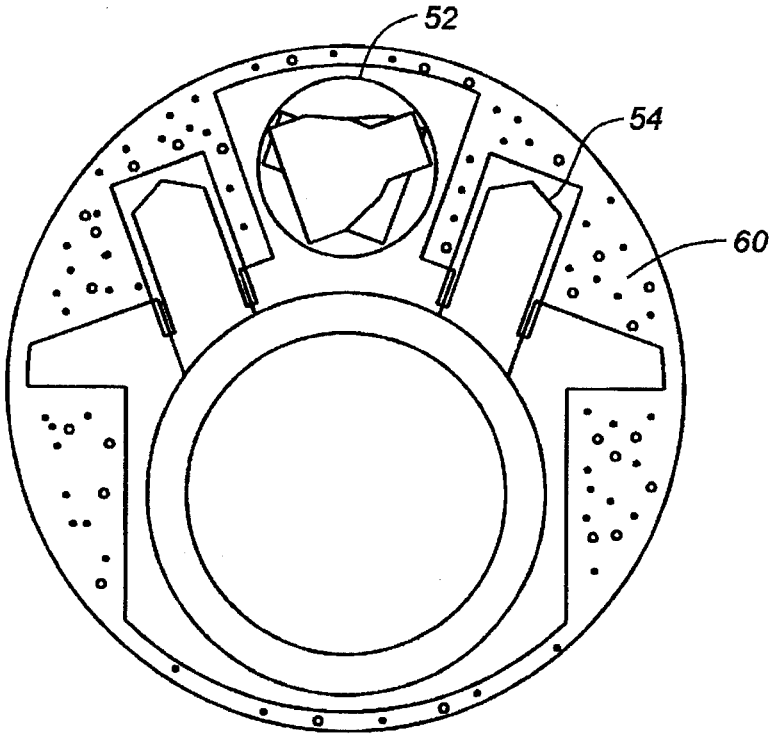
FIG. 5 is the view of FIG. 4 during the cementing operation.

In a typical operation, the hole is drilled and cased above this location and the apparatus A as a liner is installed at the base of the casing. When using the embodiment shown in FIGS. 1A–1C, the sliding sleeve 70 may be in the open or closed position at the time the charges 76 are fixed. As can be seen in examining FIG. 4, each of the plugs 78 covers an opening 80 which, when valve 70 is open, allows communication to bore 74. Plugs 78 are threaded into openings 80 at threads 82. There are milled flow areas 84 to allow the cement to completely surround the apparatus A and pass beyond it, as shown in FIG. 5. The plugs 78 and the charges 76 are isolated from the milled flow areas 84 by the exterior 86 of the apparatus A. Once the apparatus A is set in the predetermined position or positions, depending on whether there is a stack or a single unit, as illustrated in FIGS. 1 or 2, the cementing operation proceeds in a manner known to those of ordinary skill in the art. Once the cement has set as indicated in FIG. 5, perforating step takes place as shown in FIG. 6. Hydraulic pressure is built up in bore 74, which ultimately sets off all of the charges 76. Due to their phased orientation, perforation takes place as shown in FIG. 6 on an area of an angle of approximately 180°–220°. Some of the charges 76 penetrate the plugs 78 located adjacent thereto so that a plurality of openings 80 are in flow communication with bore 74 when sliding sleeve 70 is placed in the open position, as shown in FIG. 7. Additionally, fracturing fluid can be pumped into the formation as shown in FIG. 7 to further assist the fracturing operation. Thereafter, a production packer is installed and a production tubing installed above the packer so that the well may be put in service from the zone having just been fractured. Alternatively, the packer can be set and the well completed prior to setting off charges such as 76.

Figure 8:
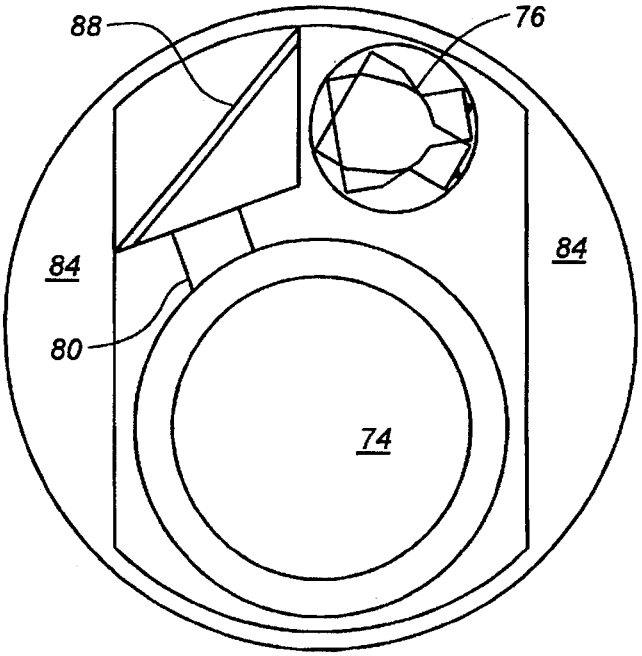
FIG. 8 is an alternative geometry to that illustrated in FIG. 3.
Figure 9:
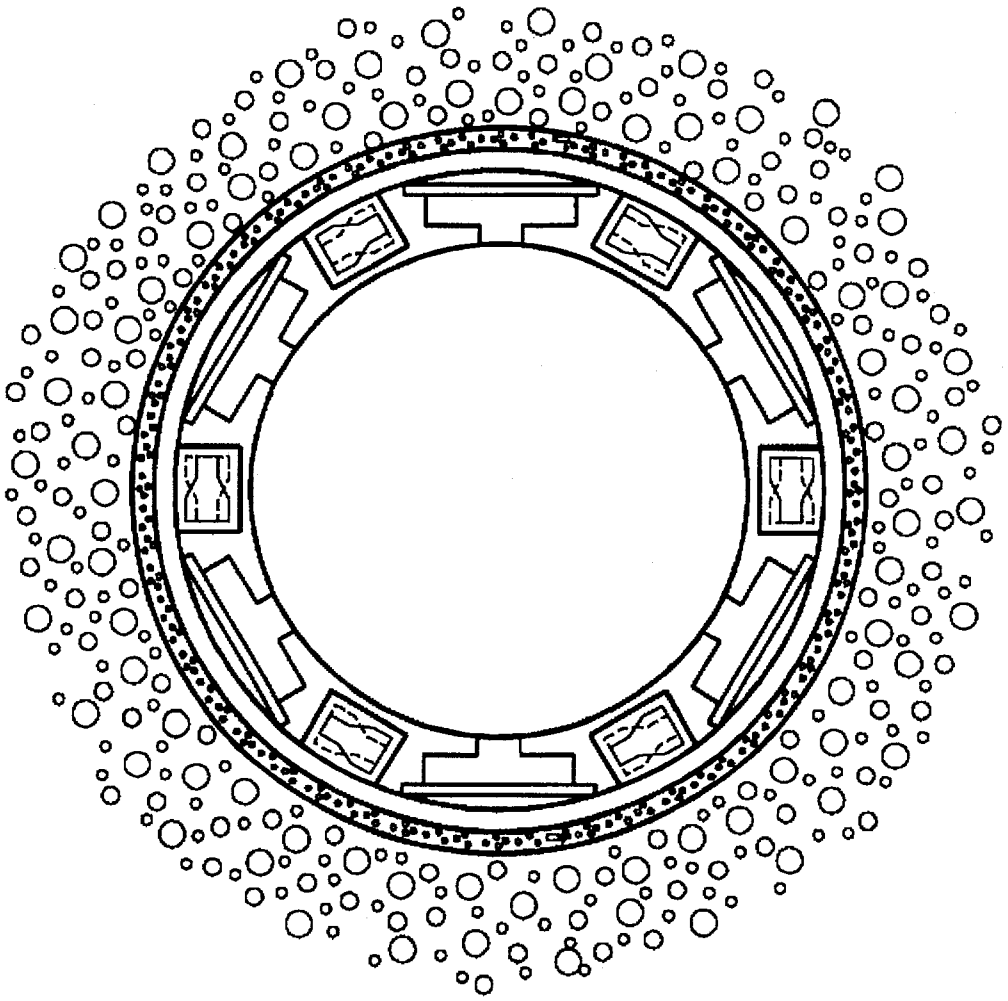
FIG. 9 is an alternative embodiment to FIG. 5, shown in the cementing operation.
Figure 10:
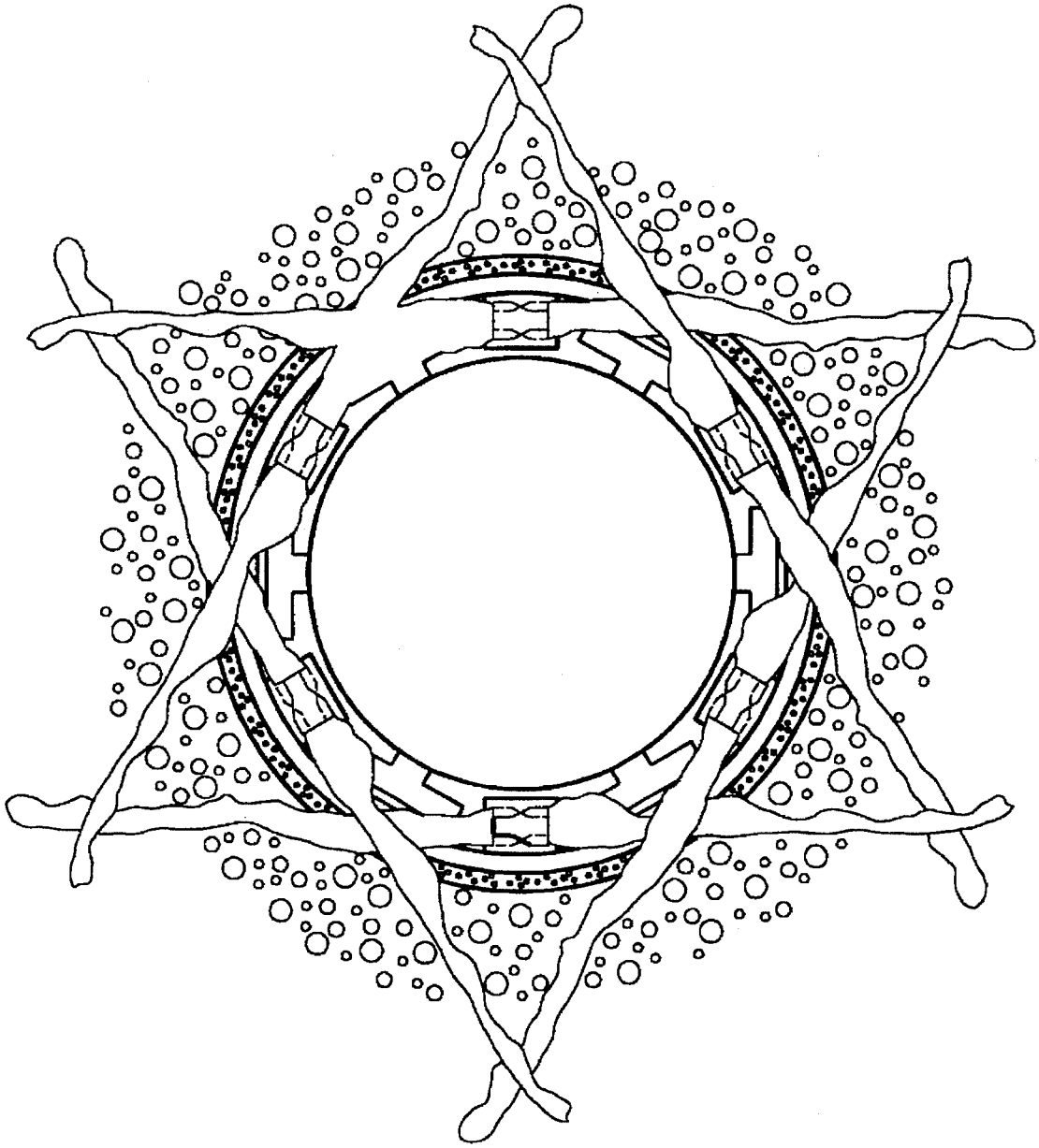
FIG. 10 is the tool of FIG. 9 in the perforating operation.
Figure 11:
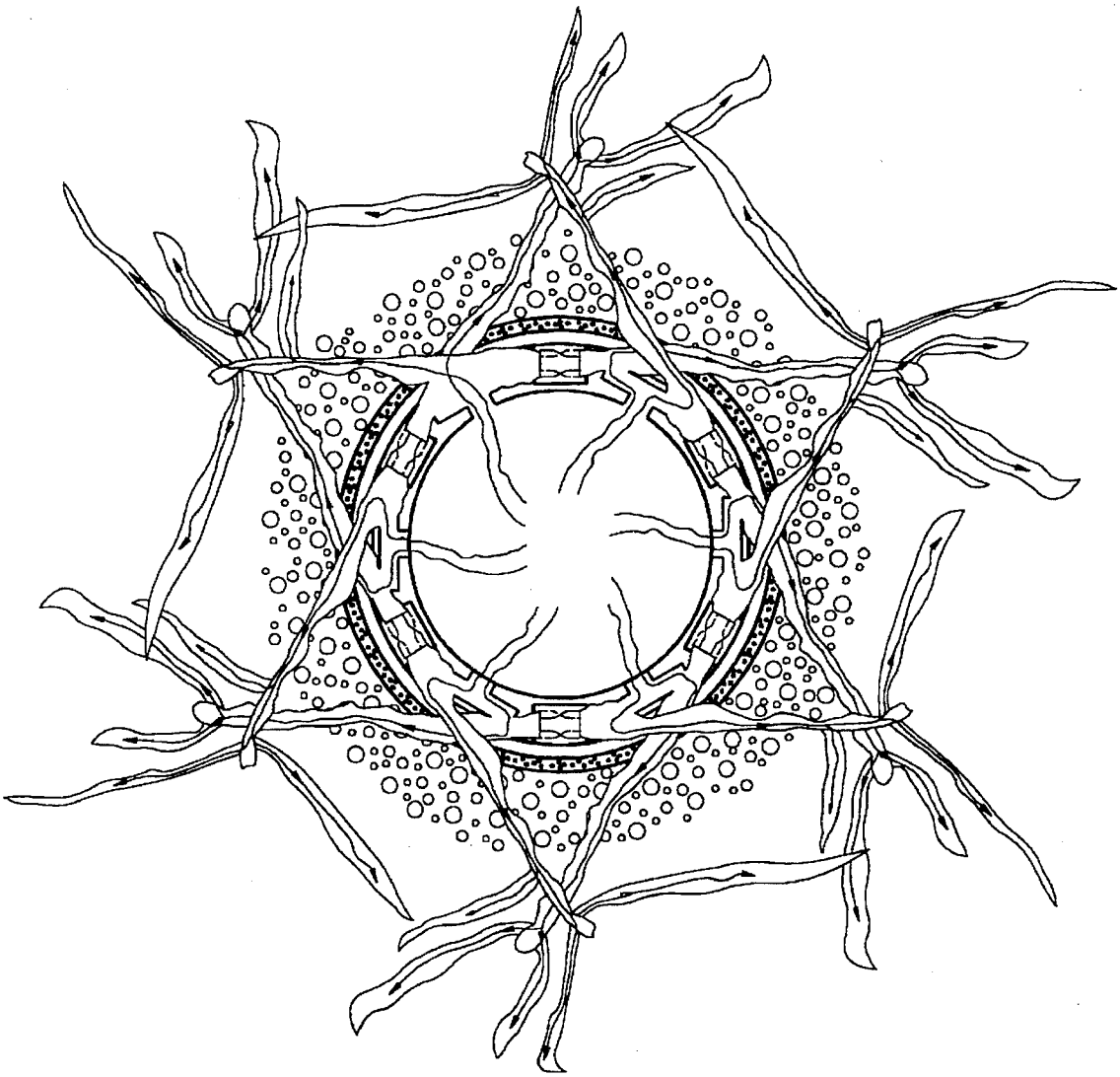
FIG. 11 is the tool of FIG. 10 in the fracturing operation.

An alternative embodiment to that shown in the sectional view of FIG. 3 or in FIG. 4 is illustrated in FIG. 8. Here, again, the bore 74 is offset from the centerline of the wellbore and the perforating charges 76 are preferably placed in a vertical array but phased in such a way that a span of approximately 0°–45° can be covered. Rather than using the plugs 78 as illustrated in FIG. 4, the ports 80 are instead covered by a welded plate 88. The charges 76 when set off blow out the welded plate 88 to provide fluid communication from the formation through ports 80 into bore 74. As in the embodiment shown in FIG. 4, there are milled flow areas 84 which allow the cement to pass all around the exterior of the apparatus A as shown in FIG. 8.

When the phasing angle is smaller, as shown in FIG. 8, i.e., an area 0°–45°, approximately six shots per foot can be installed, while in the layout shown in FIG. 3, with coverage for approximately 180°–220°, fewer shots per foot can be installed, in the order of approximately four.

Again, with the embodiment shown in FIG. 8, by controlling the size of the charges 76 and welded plates 88 and their orientation, and, if required, moving the centerline of bore 74 closer to the centerline of the wellbore, the charges 76 can be displayed in a different manner with respect to bore 74 so that the coverage area of the perforation is increased from the 0°–45° phasing shown in FIG. 8 to one where 360°-coverage is also possible.

In the preferred embodiment, each of the perforating charges 76 is oriented in such a way that upon discharge, it will encounter at least a portion of plugs 78 to open up a flowpath through port 80 into bore 74. However, it is within the scope of the invention to have some of the charges 76 oriented in such a way as to not impact any of the plugs 78 or even to have some of the charges 76 not oriented immediately adjacent a plug 76 so that the angle of firing may be anywhere within the 180°–220° layout as illustrated in FIG. 6. In its broadest sense, the invention encompasses a casing or liner with externally mounted perforation charge and at least one opening. The opening may be optionally initially closed or closable with a valve member which is opened after the charge is set off. In some applications where cementing is not required, the opening need not be covered to prevent possible plugging during cementing. A sliding sleeve valve can be used optionally to isolate certain openings as desired. The charge can either be used to do a double service of perforating and removing a plug 78 which sticks out of the apparatus A, or the opening can have a temporary obstruction that is removed by means other than the setting off of the charge, such as a sliding sleeve 70 or a dissolvable or otherwise removable material. Again, if cementing is not required, the temporary obstruction can be eliminated. The preferred embodiment is to use the explosive charge to remove the obstruction in the opening as well as to perforate the internal sliding sleeve, which is then used to open or isolate a cluster of openings.

The apparatus A and method of the present invention as shown in the figures and as described above yield several improvements over tools and techniques used in the past. First, the precise depth of the charges, such as 76, can be known because they are installed in a specific place and hung from the casing. The charges are located on the exterior of the bore 74 so that a clear and unobstructed path through the apparatus is provided. The charges 76 can be stacked by an array of the apparatus A and set off sequentially or simultaneously from the surface. Each time charges are to be set off, a trip in and out of the hole with a perforating gun is avoided.

The design of the apparatus A is very simple and gives greater assurance that the perforating will take place in an effective manner and that at the same time as the charges are set off to accomplish the perforating, the ports 80 are effectively opened for ultimate production of the formation through a packer and production string which are to be later (or earlier) installed above the liner which comprises the apparatus A. A fracturing operation can be carded out through ports 80 after perforation is complete.

By providing milled flow areas, accurate and complete cementing of the liner is assured. The entire available space offered by the wellbore can be used so that the greatest dimension of the apparatus A in a well that has a bore of approximately 8 ½" can be approximately 8"–8 ¼". By making full use of the available room, the charges 76 are placed as close to the formation as possible while at the same time being in the path of the plugs 78 to ensure that the setting off of the charges 76 not only accomplishes the perforating effectively but also opens up the ports 80 to the bore 74. While an offset design has been illustrated, it is also within the purview of the invention to use a symmetrical design and put the charges 76 around the periphery of the bore 74 to obtain a greater coverage area than the 180°–220° range illustrated in FIGS. 6 and 7 from the offset design.

By placing the charges on the outside of the apparatus A and closer to the formation than a standard perforating gun, the effectiveness of the perforations is increased.

The foregoing disclosure and description of the invention are illustrative and explanatory thereof, and various changes in the size, shape and materials, as well as in the details of the illustrated construction, may be made without departing from the spirit of the invention.

I claim:

1. A well-perforating apparatus, comprising:

a tubular body insertable in a wellbore to serve as a portion of a liner or casing of the wellbore;

said body having an inner bore, and an outer face facing the wellbore;

at least one selectively covered port through said body;

at least one explosive member positioned on said outer face and offset from said port for perforating the wellbore and selectively opening said port when set off.

2. The apparatus of claim 1, wherein said port is initially obstructed by an obstructing member extending beyond said outer face of said body;

said explosive member oriented in such a manner that when it is set off, said obstructing member is sufficiently impacted to open up said port, allowing flow communication from said outer face into said inner bore of said tubular body.

3. The apparatus of claim 2, further comprising:

a plurality of said ports, each obstructed by an obstructing member; a plurality of explosive members, with at least one oriented adjacent an obstructing member;

a valve member in said body, movable between a closed position coveting said ports and an open position uncovering said ports.

4. The apparatus of claim 3, wherein:

said explosive members are set off with applied pressure in said body.

5. The apparatus of claim 3, wherein:

said ports and said explosive members are oriented to perforate for up to 360° around said outer face of said body.

6. A well-perforating apparatus, wherein:

a tubular body insertable in a wellbore to serve as a portion of a liner or casing of the wellbore;

said body having an inner bore, and an outer face facing the wellbore;

a plurality of ports through said body;

a plurality of explosive members mounted to said outer face for perforating the wellbore when set off;

said ports arc initially obstructed by an obstructing member extending beyond said outer face of said body;

said plurality of explosive members oriented in such a manner that when they are set off, said obstructing members are sufficiently impacted to open up said ports, allowing flow communication from said outer face into said inner bore of said tubular body;

a valve member in said body, movable between a closed position covering said ports and an open position uncovering said ports;

a plurality of clusters of said openings, disposed at discrete longitudinal intervals from each other;

said body further comprises:

a set-off mechanism for each said cluster; and a delay for at least one of said set-off mechanisms, allowing for actuation of said explosive members from at least one cluster at a different time than said explosive members from another said cluster.

7. The apparatus of claim 6, wherein said delay mechanisms further comprise:

fuses of different lengths for said clusters to accomplish said delay.

8. The apparatus of claim 6, wherein:

said ports and said explosive members are oriented to perforate for up to 360° around said outer face of said body.

9. A method of perforating a wellbore, comprising the steps of:

positioning at least one explosive charge on an exterior of a tubular body which serves as a casing or liner for a wellbore;

providing at least one covered opening on said tubular body through its wall;

mounting said explosive charge in an offset location from said port;

positioning said body in a wellbore;

setting off said explosive charge; and uncovering said opening and perforating the wellbore by virtue of said setting off.

10. The method of claim 9, further comprising the steps of:

providing a plug in said opening;

explosively removing at least a potion of said plug during said setting off step.

11. The method of claim 10, further comprising the steps of:

providing a plurality of plugged openings;

providing an explosive charge adjacent each said opening;

orienting said openings and adjacent charges in a manner to perforate up to 360° around said body.

12. The method of claim 11, further comprising the steps of:

providing a plurality of clusters of plugged openings with adjacent explosive charges;

spacing said clusters longitudinally on said body;

triggering said explosive charges of at least one cluster to go off at a different time than another cluster.

13. The method of claim 9, further comprising the step of:

providing a valve in said body to selectively cover said opening.

14. The method of claim 13, further comprising the step of:

setting off said charge by pressure in said body independent of the position of said valve.

15. A method of perforating a wellbore, comprising the steps of:

mounting at least one explosive charge on an exterior of a tubular body which serves as a casing or liner for a wellbore;

providing at least one covered opening on said tubular body through its wall;

positioning said body in a wellbore;

setting off said explosive charge;

uncovering said opening after said setting off;

accomplishing said uncovering step as a result of said setting off step;

providing a valve in said body to selectively cover said opening; and obstructing access to set off said explosive charge by pressure when said valve is in a closed position.

16. The method of claim 15, further comprising the step of:

setting off said charge using fluid pressure.

17. A well-perforating tool, comprising:

a body having at least one preformed wall opening therethrough;

at least one explosive charge positioned outside said body and offset from said opening;

at least one valve member for selective obstruction of said opening;

said charge oriented in such a manner so as to disable said valve member when set off to perforate the wellbore.

18. A well-perforating apparatus, wherein:

a tubular body insertable in a wellbore to serve as a portion of a liner or casing of the wellbore;

said body having an inner bore, and an outer face facing the wellbore;

a plurality of ports through said body;

a plurality of explosive members mounted to said outer face for perforating the wellbore when set off;

said ports are initially obstructed by an obstructing member extending beyond said outer face of said body;

said explosive members oriented in such a manner that when they are set off, said obstructing members are sufficiently impacted to open up said ports, allowing flow communication from said outer face into said inner bore of said tubular body;

a valve member in said body, movable between a closed position covering said ports and an open position uncovering said ports;

said explosive members are set off with applied pressure in said body; and said valve member prevents applied pressure in said body from actuating said explosive members when in its said closed position.

19. The method of perforating a wellbore, comprising the steps of:

mounting a plurality of explosive charges on an exterior of a tubular body which serves as a casing or liner for a wellbore;

providing a plurality of plugged openings on said tubular body through its wall;

providing an explosive charge adjacent each said opening;

orienting said openings and adjacent charges in a manner to perforate up to 360° around said body;

positioning said body in a wellbore;

setting off said explosive charge;

uncovering said openings after said setting off;

accomplishing said uncovering step as a result of said setting off step;

explosively removing at least a portion of said plugs during said setting off step; providing a plurality of clusters of plugged openings with adjacent explosive charges; spacing said dusters longitudinally on said body;

triggering said explosive charges of at least one cluster to go off at a different time than another duster; and using a time delay to stagger triggering of said clusters.

* * * * *